US006652678B1

(12) United States Patent
Marshall et al.

(10) Patent No.: US 6,652,678 B1
(45) Date of Patent: Nov. 25, 2003

(54) AA6000 ALUMINUM SHEET METHOD

(75) Inventors: Graeme John Marshall, Banbury (GB); Karl Albert Herbst, Dusseldorf (DE); Martin Heinze, Hofheim/Taunus (DE); Richard Hamerton, Chipping Norton (GB)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/913,469

(22) PCT Filed: Feb. 28, 2000

(86) PCT No.: PCT/GB00/00702

§ 371 (c)(1),
(2), (4) Date: Oct. 31, 2001

(87) PCT Pub. No.: WO00/52219

PCT Pub. Date: Sep. 8, 2000

(30) Foreign Application Priority Data

Mar. 1, 1999 (EP) ..... 99301494

(51) Int. Cl.[7] ..... C22F 1/05
(52) U.S. Cl. ..... 148/552; 148/691; 148/695
(58) Field of Search ..... 148/549, 552, 148/688, 691, 695

(56) References Cited

U.S. PATENT DOCUMENTS 3,990,922 A 11/1976 Gullotti et al.
4,066,476 A 1/1978 Gullotti et al.
5,266,130 A * 11/1993 Uchida et al. ..... 148/552
5,480,498 A 1/1996 Beaudoin et al.

FOREIGN PATENT DOCUMENTS

WO WO8201014 4/1982
WO WO9835069 8/1998

OTHER PUBLICATIONS

Abstract of Japanese Patent Publication No. 05 263203, Patent Abstract of Japan, published Oct. 12, 1993.

Abstract of Japanese Patent Publication No. 63 109146, Patent Abstracts of Japan, published May 13, 1988.

Alloy and Temper Designation Systems for Aluminum and Aluminum Alloys, Metals Handbook, 10$^{th}$ Edition, vol. 2, p. 19, 1990.

* cited by examiner

*Primary Examiner*—George Wyszomierski
*Assistant Examiner*—Janelle Combs Morillo
(74) *Attorney, Agent, or Firm*—Cooper & Dunham LLP

(57) ABSTRACT

A method of converting an ingot of a 6000 series aluminium alloy to self-annealing sheet, comprises subjecting the ingot to a two-stage homogenisation treatment, first at at least 560° C. and then at 450° C. to 480° C., then hot rolling the homogenised ingot at a starting hot roll temperature of 450° C. to 480° C. and a finishing hot roll temperature of 320° C. to 360° C. The resulting hot rolled sheet has an unusually low Cube recrystallisation component.

9 Claims, 2 Drawing Sheets

AA6000 ALUMINUM SHEET METHOD

Figure 1:
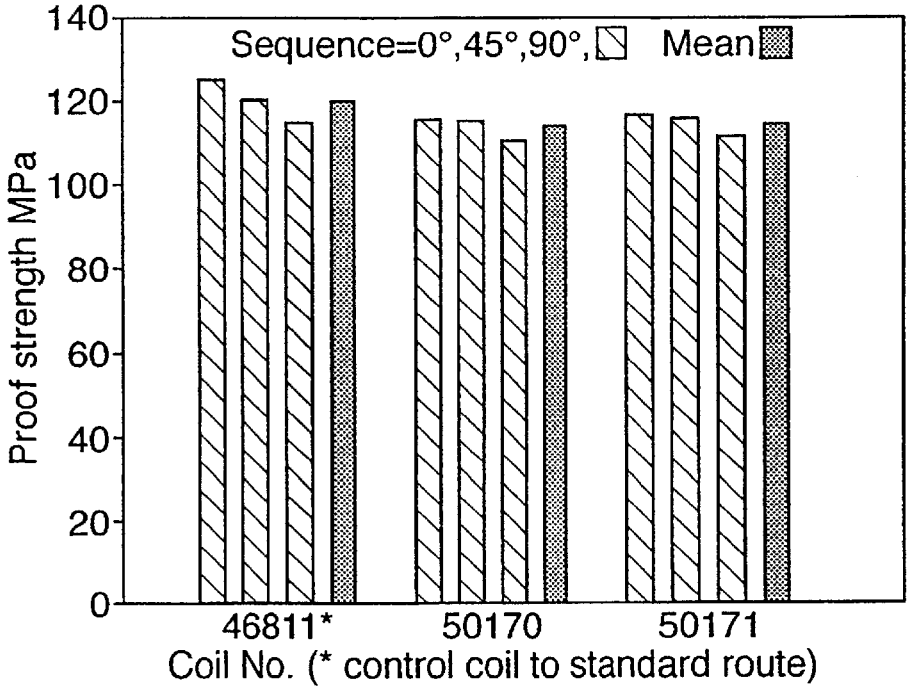

External closure sheet panels for automotive applications require a high degree of surface finish including the absence of surface roughening due to forming operations. AA6000 sheet is prone to a phenomenon called roping, which is the effect seen from macroscopic surface undulations caused by stretching during pressing. Conventional routes to prevent this phenomenon, i.e. to provide roping-free sheet, involve a recrystallisation anneal either before or between cold rolling passes and can be performed either by a batch or a continuous process. These processes are costly in terms of both time and energy. Additionally, the introduction of an annealing step can adversely influence the ability to solution heat-treat at final gauge, thus lowering the attainable strength before and after paint bake.

It is known that certain aluminium alloys (not including 6000 series alloys) can be subjected to hot rolling under conditions which cause them to be self-annealing, that is to say, to recrystallise without the need of a specific recrystallisation annealing step. This invention concerns the treatment of 6000 series alloys in such a way as to make hot-rolled sheet self-annealing.

In one aspect the invention provides a method of converting an ingot of a 6000 series aluminium alloy to self-annealing sheet, which method comprises subjecting the ingot to a two-stage homogenisation treatment, the first stage being at a temperature of at least 560° C. and the second stage at a temperature of 450° C. to 480° C., and then hot-rolling the homogenised ingot at a starting hot roll temperature of 450° C. to 480° C. and a finishing hot roll temperature of 320° C. to 360° C. The hot-rolled sheet is caused to be self-annealing by a careful control of treatment conditions, as discussed in more detail below, and also by control over the alloy composition. Preferred alloy composition is (in wt %)

| | |
|---|---|
| Si | 0.3–1.8 preferably 0.9–1.3 |
| Fe | up to 0.5 preferably 0.15–0.4 |
| Mg | 0.30–1.5 preferably 0.35–0.50 |
| Cu | up to 0.3 preferably up to 0.2 |
| Mn | 0.03–0.2 preferably 0.04–0.10 |
| Cr | up to 0.35 preferably 0.01–0.15 |
| Others | up to 0.05 each and 0.15 total |
| Al | balance. |

Alloys containing a high copper content would not show satisfactory self-annealing properties. Hence Cu is preferably kept at a low level. During homogenisation of the ingot, Mn-containing dispersoids coarsen and these coarsened dispersoids later contribute to the self-annealing properties of the hot-rolled sheet. For this effect to be notable, the Mn content of the alloy needs to be at least 0.03 or 0.04% by weight. At Mn contents above 0.1 or 0.2 weight % the recrystallisation temperature increases to a level impractical to attain in hot rolling. Cr is preferably included in the alloy in order to keep Mn in a finely dispersed form. Other alloy components, e.g. Si, Fe and Mg, may be present at concentrations usual for AA6000 alloys for they do not have any major effect on the self-annealing properties described herein.

Alloy of the required composition is cast into ingots, typically by d.c. casting although the casting technique is not material to the invention. Ingots are subjected to a two-stage homogenisation, the first stage being at a temperature of at least 560° C., preferably at least 570° C. for at least one hour. A maximum homogenisation temperature is set by the need to avoid re-melting the ingot, and is for practical purposes 590° C. Mn is present as dispersoids and a major purpose of this high-temperature homogenisation is to coarsen the dispersoids, e.g. to a mean $D_C$ (equivalent diameter) of at least 0.25 $\mu$m, to an extent that they enhance recrystallisation at a later stage. Homogenisation time and temperature should be chosen with this in mind.

In the second stage of homogenisation, the ingots are brought to a temperature of 450° C. to 480° C., preferably 460° to 480° C. Ingots may be cooled from first stage homogenisation to ambient temperature and then re-heated, or more preferably may simply be cooled from first stage to second stage homogenisation temperature. Ingots cooled from first stage homogenisation to below hot rolling temperature should preferably be reheated to at least 500° C., in order to re-solutionise Mn dispersoids, prior to cooling to the second homogenisation temperature of 450° C. to 480° C. The ingots should be brought into thermal equilibrium at the second stage homogenisation temperature, which is not otherwise metallurgically significant.

The homogenisation ingots are then hot rolled at a starting hot roll ingot temperature of 450° C. to 48$^0$0C, preferably 460° C. to 480° C., and a finishing hot roll ingot temperature of 320° C. to 360° C., preferably 330° C. to 350° C. Preferably hot rolling is performed in two stages. In a first stage, an ingot is passed repeatedly forwards and backwards through a breakdown mill to reduce the thickness to 30 to 50 mm. This first stage is typically performed under substantially isothermal conditions, and the resulting slab preferably has a temperature of 430° C. to 470° C. If the slab is too cold, it may be unrollable in the next stage. If the slab is too hot, it may be difficult to roll fast enough to achieve the desired final hot rolled sheet microstructure.

A second hot rolling stage typically involves passage through a three or four or five stand Tandem mill. Typically passage through each stand cools the slab by 40° C. to 50° C., but in the current invention this is reduced by high speed rolling of a relatively cold slab. Preferably there is at least a 90% thickness reduction during this second hot-rolling stage with preferably (to encourage recrystallisation) a larger than average reduction in the last stand. Preferably the thickness reduction in the last stand is greater than in the immediately preceding stand e.g. is at least 45%.

Energy imparted during this Tandem mill rolling stage should be enough to cause recrystallisation, but not so much that significant recovery takes place between rolling passes.

The hot rolled sheet exits the last stand at a temperature of 320° C. to 360° C. preferably 330° C. to 350° C. If the exit temperature is either too high or too low, then recrystallisation may not take place due to a lack of either stored energy or thermal energy, respectively. The hot rolled sheet is coiled and allowed to cool to ambient temperature.

Recrystallisation typically takes place during the early stages of cooling, while the sheet is still above 270° C. to 290° C. The hot rolled sheet typically has a thickness of 2 to 4 mm. It is then cold-rolled down to a desired final thickness, under conditions which may be conventional except that no recrystallisation anneal is required either before or during cold rolling (although a recovery anneal or recrystallisation anneal. is not excluded). The cold rolled sheet is subjected to solution heat treatment under conditions which may be conventional, is optionally lubricated or coated, and may then be coiled or cut to length.

The as hot rolled sheet constitutes another aspect of this invention. It is in a recrystallised state and has a texture characterised by a Cube recrystallisation component lower than that found in an alloy of the same composition that has been given a recrystallisation anneal after hot rolling. Preferably the Cube recrystallisation component of the invention product is at least 3 volume % less than that of a comparable product produced by a conventional process. For example, in the alloy used in the experimental section below, the invention product had a Cube component of 29.0 volume %, where the conventional product had a Cube component of 35.9 to 37.4 volume % (see Table 2).

The sheet which has been hot rolled, cold rolled and then solution heat treated, constitutes another aspect of the invention which may be defined in different ways. Preferably the sheet has a texture in which the combined volume % of the Brass (Bs) and Cu and S recrystallisation components is at least 1.5 times the combined volume % of the Cube and Goss recrystallisation components. Products according to the invention are substantially more balanced between recrystallisation components (Cube and Goss) and deformation components (Brass, Cu and S) than is a comparable product produced by a conventional route including a recrystallisation anneal. For measurement of the recrystallisation components, see Van Houtte 1991 'Textures & Microstructures', 13 pages 199–212. Measurements reported herein have been made at 15° The invention products are also free of roping which generally implies a rather low Goss recrystallisation component, typically below 5.

Preferably the 6000 series aluminium sheet which has been hot rolled, cold rolled and then solution heat treated, has a mean planar anisotropy r value of at least 0.53. This is higher than generally found with comparable alloys processed by conventional route involving recrystallisation anneal (see FIG. 3 below). Mean planar anisotropy of rolled sheet is defined as: (longitudinal plus transverse plus twice the 45° anisotropies) divided by 4.

There follows a description of a plant trial in which three ingots of identical composition were subjected to thermomechanical processing, one by a conventional route and the other two by a trial route in accordance with this invention. The composition of the alloy was: Si 1.09%; Fe 0.30%; Mg 0.38%; Cu 0.07%; Mn 0.05%; Cr 0.03%; Ti 0.01%; Al balance.

The trial conditions are summarised in the following Table 1.

In commercial production, the cool to room temperature between the two stages of homogenisation would be eliminated, and the ingot would simply be cooled from 570° C. to 480° C. for rolling. In metallurgical terms, this would be the same as the route here described.

TABLE 1

| Conventional Route 46811 | Trial Route 50170 and 50171 |
|---|---|
| Ingot 600 × 4200 × width | Ingot 600 × 4200 × width |
| Homogenisation: 10–20 h cycle | Homogenisation: |
| Soak temp. 520–550° C. | Step 1; 570° C. PMT cool to RT |
| | Step 2; reheat to 525° C. PMT cool to 480° C. |
| Start hot roll; 500–520° C. | Start hot roll; 460–480° C. |
| Slab gauge: 40 mm | Slab gauge: 40 mm |
| Slab temp: 490–510° C. | Slab temp: 450–470° C. |
| Finish hot roll; 300–320° C. | Finish hot roll; 330–360° C. |
| Re-roll gauge; 3 mm | Re-roll gauge 3 mm |
| Batch anneal at 350–400° C.; 1 hour | Batch anneal; none |
| Cold roll; 55–70% | Cold roll; 55–70% |
| SHT; >560° C. + Quench | SHT; >560° C. + Quench |
| Optional coating; re-lube or dry film | Optional coating; re-lube or dry film |
| Cut to length | Cut to length |

The ingot processed by the conventional route was numbered 46811. The two ingots processed by the trial route were numbered 50170 and 50171. The finishing hot roll temperatures (coil temperatures) of the two trial materials were not under precise control, but were determined to be 344° C. for 50170 and 355° C. for 50171. The conventional route has been established to produce unrecrystallised hot-rolled sheet which subsequently recrystallises during batch annealing. In contrast, the self-anneal coils were expected to recrystallise and this was indeed found to be the case. On inspection after holding for 24 hours at ambient temperature, there was found to be little or no difference between them regarding grain structure or grain size.

After cold rolling and solution heat treatment, samples received from the three ingots were subjected to testing evaluation. A key test was a roping assessment, which is performed in the T4 condition by stretching the sheet 15% in the transverse orientation. The standard product (coil 46811) and the two self-anneal coils (numbers 50170 and 50171) were all roping free. The trial objective was thus achieved, a process route was demonstrated that produces a roping free AA6016 coil with a hot mill coil self-anneal.

A laboratory study of the T4 strength, paint bake response and general formability was performed on final gauge sheet from the three coils. FIG. 1 shows T4 proof strength measured after 8 weeks in three directions at 0, 45° and 90° to longitudinal. Although the control coil is consistently 5 MPa stronger, this would be expected to fit within a normal statistical production range.

Figure 2:
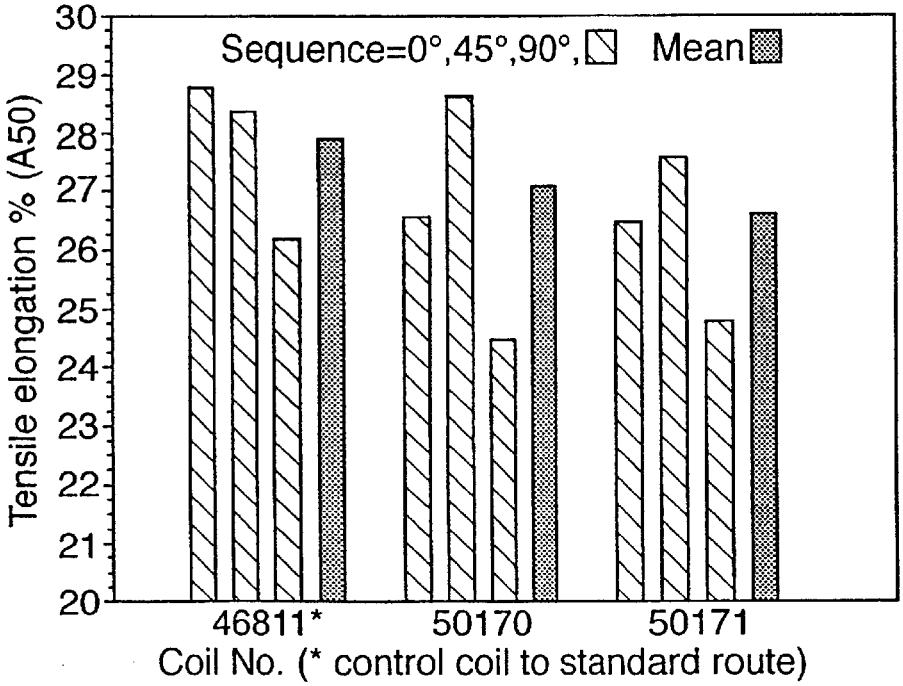

Tensile ductility after 8 weeks is shown in FIG. 2. Here there is a more significant difference between the self anneal coils and the control coil. The two self anneal coils are on average 1% less ductile than 15 the control sample and display a different anisotropy with the 45° orientation exhibiting the highest values, compared to 0° for coil number 46811.

Figure 3:
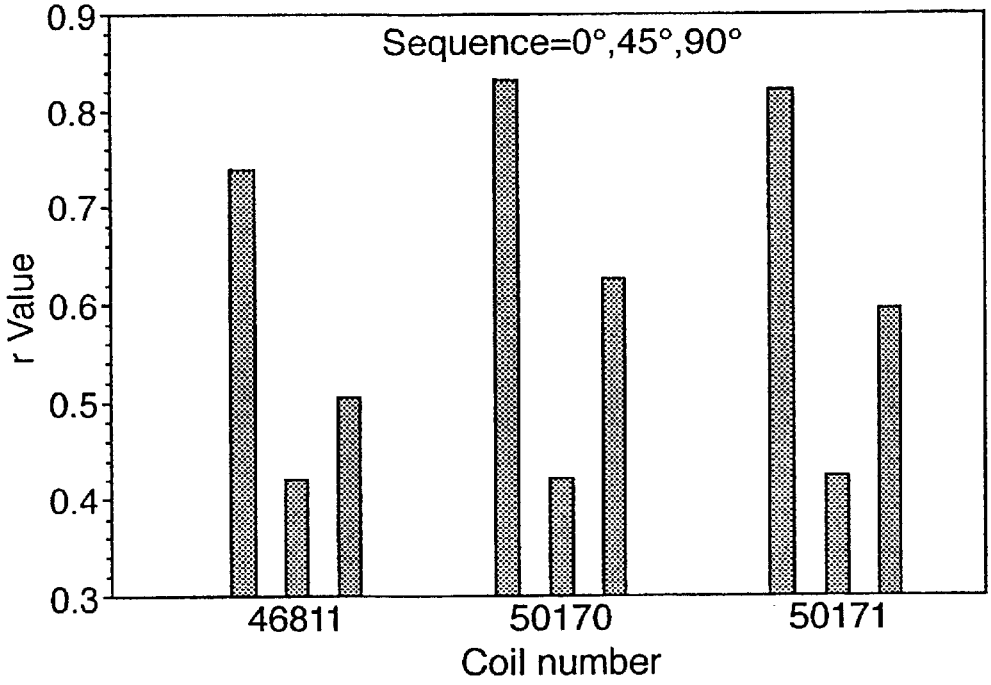

FIG. 3 shows the T4 planar anisotropy "r" value at 10% strain, which is substantially different between the conventional and trial 20 products. The mean r value ($r_L+r_T+2r_{45}/4$) is increased by approximately 10% in the self anneal coils, and this will benefit formability.

Figure 4:
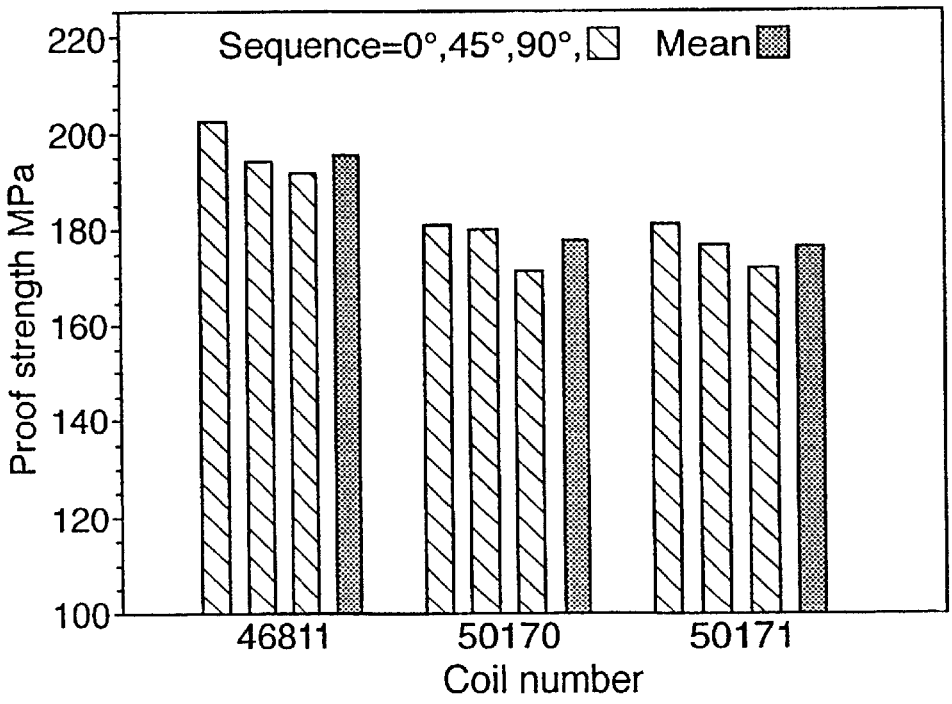

FIG. 4 shows the T8X proof strength of the three coils after 8 weeks natural ageing. There is again a small difference between the self anneal coils and the control coil. In this data, it is believed that the processing route has in some unspecified manner reduced the paint bake response of the two trial coils.

A crystallographic texture comparison was made between conventional and trial samples, and the results are set out in Table 2. The first three rows represent the hot rolled product, and the Cube recrystallisation component of the invention product (29.0%) is characteristically lower than of the conventional product (35.9%, 36.8%). The fourth and fifth rows represent the final product in a T4 state, and the recrystallisation components are more balanced in the invention product than in the conventional product. Thus (Bs +Cu +S)/(Cube +Goss) is 2.3 for the invention material compared to 0.9 for the conventional material.

TABLE 2

Crystallographic Texture Comparison between Conventional & Trial Samples

| Route | Sample Condition | Recrystallisation Components Vol % Cube | Goss | Bs | Cu | S |
|---|---|---|---|---|---|---|
| Invention | Re-roll | 29.0 | 3.1 | 4.5 | 3.3 | 14.3 |
| Conventional | Re-roll + Batch anneal | 35.9 | 2.4 | 2.8 | 2.3 | 14.4 |
| Production metal* | Re-roll + Batch anneal | 36.8(.6) | 1.8(3) | 3.0(.6) | 2.6(.4) | 14.9(.4) |
| Invention | Final Gauge T4 | 9.7 | 2.2 | 5.7 | 7.3 | 14.4 |

TABLE 2-continued

| Crystallographic Texture Comparison between Conventional & Trial Samples | | | | | | |
|---|---|---|---|---|---|---|
| | Sample | Recrystallisation Components Vol % | | | | |
| Route | Condition | Cube | Goss | Bs | Cu | S |
| Conventional | Final Gauge T4 | 11.4 | 3.3 | 4.0 | 1.7 | 7.6 |
| Random | | 3.5 | 3.5 | 7.0 | 7.0 | 14.0 |

* Large sample size, identical to conventional coil route, std. Deviation in ( ).

What is claimed is:

1. A method of converting an ingot of a 6000 series aluminium alloy to self-annealing sheet, which method comprises subjecting the ingot to a two-stage homogenisation treatment, the first stage being at a temperature of at least 560° C. and the second stage at a temperature of 450° C. to 480° C., and then hot-rolling the homogenised ingot at a starting hot roll temperature of 450° C. to 480° C. and a finishing hot roll temperature of 320° C. to 360° C.

2. The method of claim 1, wherein the alloy comprises up to 0.3 wt % Cu.

3. The method of claim 1, wherein the alloy comprises up to 0.2 wt % Mn.

4. The method of claim 1, wherein the alloy composition is (in wt %)

| | |
|---|---|
| Si | 0.3–1.8 |
| Fe | up to 0.5 |
| Mg | 0.30–1.5 |

-continued

| | |
|---|---|
| Cu | up to 0.3 |
| Mn | 0.03–0.2 |
| Cr | up to 0.35 |
| Others | up to 0.05 each and 0.15 total |
| Al | balance. |

5. The method of claim 1, wherein the ingot is held at a temperature of at least 570° C. for at least one hour in the first stage of the homogenisation treatment.

6. The method of claim 1, wherein the homogenised ingot is hot rolled to a slab having a temperature of 430° C. to 470° C., and the slab is then converted to sheet by reducing its thickness by at least 90%.

7. The method of claim 1, wherein the hot rolled sheet is converted to final gauge by cold rolling.

8. The method of claim 6, wherein there is no annealing step either after hot rolling or between cold rolling passes.

9. The method of claim 1, wherein the alloy composition is (in wt %)

| | |
|---|---|
| Si | 0.9–1.3 |
| Fe | 0.15–0.4 |
| Mg | 0.35–0.50 |
| Cu | up to 0.2 |
| Mn | 0.04–0.10 |
| Cr | 0.01–0.15 |
| Others | up to 0.05 each and 0.15 total |
| Al | balance. |

* * * * *